US009656182B2

(12) United States Patent
Kojima

(10) Patent No.: US 9,656,182 B2
(45) Date of Patent: May 23, 2017

(54) ORNAMENT MANUFACTURING METHOD, ORNAMENT AND STICK TOY

(71) Applicant: KABUSHIKI KAISHA PRODIA, Gunma (JP)

(72) Inventor: Yoshiyasu Kojima, Gunma (JP)

(73) Assignee: KABUSHIKI KAISHA PRODIA, Gunma (JP)

( * ) Notice: Subject to any disclaimer, the term of this patent is extended or adjusted under 35 U.S.C. 154(b) by 0 days.

(21) Appl. No.: 15/306,904

(22) PCT Filed: Jan. 29, 2016

(86) PCT No.: PCT/JP2016/052668

§ 371 (c)(1),
(2) Date: Oct. 26, 2016

(87) PCT Pub. No.: WO2016/121931

PCT Pub. Date: Aug. 4, 2016

(65) Prior Publication Data

US 2017/0043273 A1 Feb. 16, 2017

(30) Foreign Application Priority Data

Jan. 29, 2015 (JP) ..... 2015-014933

(51) Int. Cl.
*A63H 1/00* (2006.01)
*A63H 33/22* (2006.01)
*A63H 33/00* (2006.01)

(52) U.S. Cl.
CPC ..... *A63H 33/22* (2013.01); *A63H 33/00* (2013.01)

(58) Field of Classification Search
USPC ..... 434/81, 82, 96, 97, 300, 303; 428/7, 8, 428/9, 11; 446/236; 472/57, 80
See application file for complete search history.

(56) References Cited

U.S. PATENT DOCUMENTS 4,014,088 A * 3/1977 Oshier ..... A47G 33/08 29/407.09
4,884,328 A * 12/1989 Neighbors ..... B44C 3/082 206/572

(Continued)

FOREIGN PATENT DOCUMENTS

JP 3116440 U 12/2005
JP 2010-214089 A 9/2010

(Continued)

OTHER PUBLICATIONS

International Search Report and Written Opinion issued in PCT/JP2016/052668 on May 10, 2016.

*Primary Examiner* — Kurt Fernstrom
(74) *Attorney, Agent, or Firm* — McClure, Qualey & Rodack, LLP

(57) ABSTRACT

A method of manufacturing an ornament includes: providing a pair of continuous regions facing one another in a flexible sheet; forming a plurality of slits between the pair of continuous regions to form a plurality of ornament strips, wherein the plurality of ornament strips are separated from each other while both ends of the plurality of ornament strips are integrally formed with the pair of continuous regions; and reversing the plurality of ornament strips with respect to the pair of continuous regions such that the plurality of ornament strips radiate to form into an arc between the pair of continuous regions, while coupling each of the pair of continuous regions to be formed into a ring.

8 Claims, 6 Drawing Sheets

(56) References Cited

U.S. PATENT DOCUMENTS

| | | | | | |
|---|---|---|---|---|---|
| 5,130,169 | A | * | 7/1992 | DeJaynes | D04D 7/10 156/294 |
| D375,605 | S | * | 11/1996 | Balish, Jr. | D26/87 |
| 5,609,928 | A | * | 3/1997 | Yedlin | D04D 7/10 156/187 |
| 5,873,766 | A | * | 2/1999 | Burton | A63H 5/00 446/419 |
| 6,042,903 | A | * | 3/2000 | Yedlin | D04D 7/04 156/187 |
| D574,292 | S | * | 8/2008 | Jost | D11/131 |
| D586,031 | S | * | 2/2009 | Urquiola | D26/105 |
| 7,927,674 | B2 | * | 4/2011 | Spaar | G09F 1/08 40/1 |
| D673,722 | S | * | 1/2013 | Cartwright | D26/138 |
| 2005/0097799 | A1 | * | 5/2005 | Murthy | G09F 19/12 40/617 |
| 2014/0030953 | A1 | | 1/2014 | Tanigawa | |

FOREIGN PATENT DOCUMENTS

| | | | |
|---|---|---|---|
| JP | 3166973 | U | 3/2011 |
| JP | 2014-39804 | A | 3/2014 |

* cited by examiner

*FIG.1*A
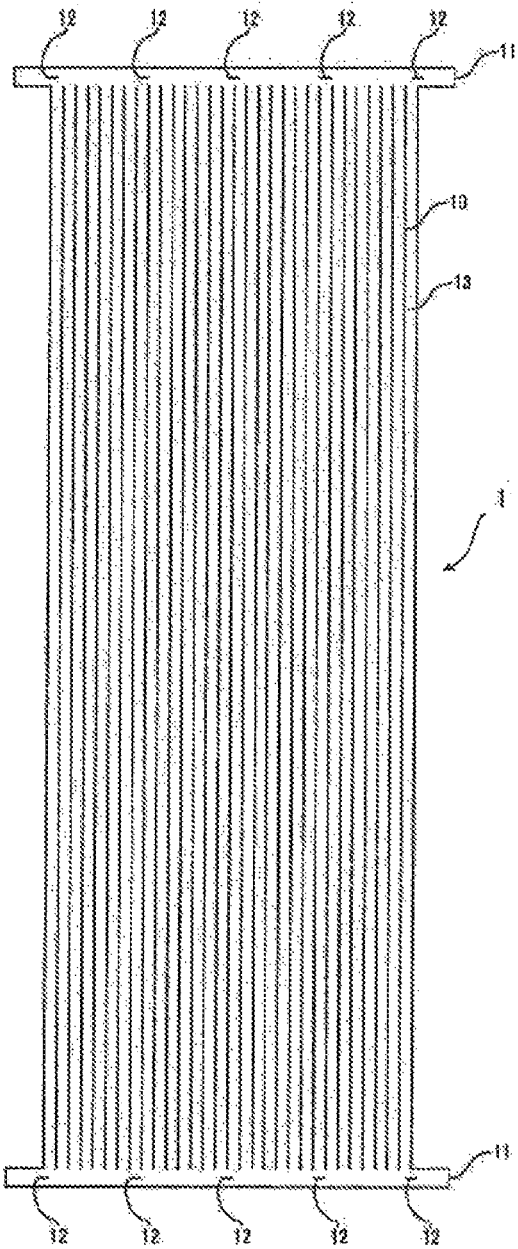
*FIG.1*B
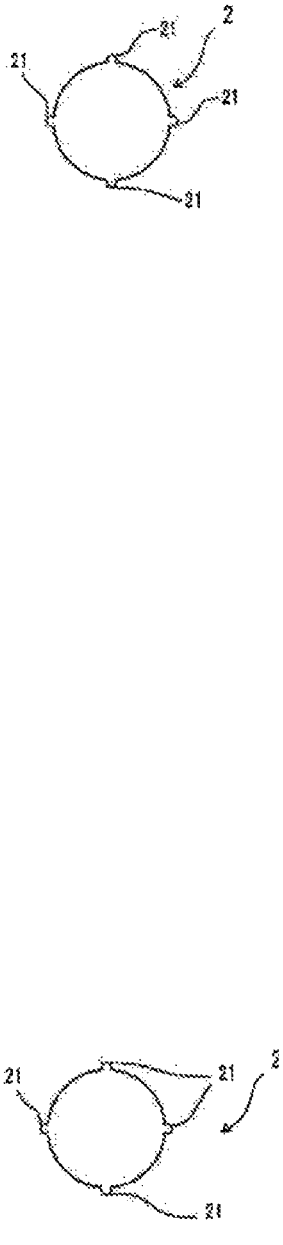

*FIG.2* A
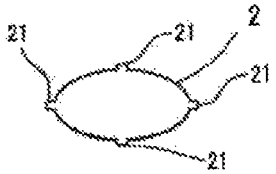
*FIG.2* B
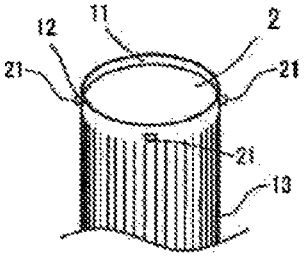
*FIG.2* C
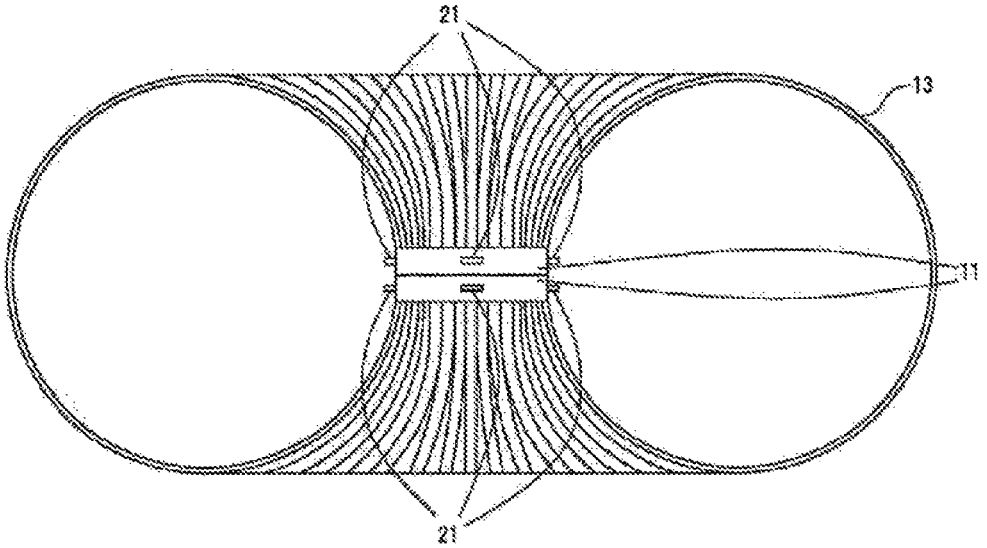

*FIG.3* A
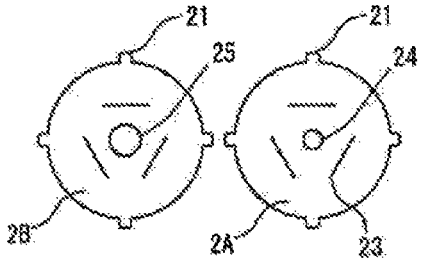
*FIG.3* B
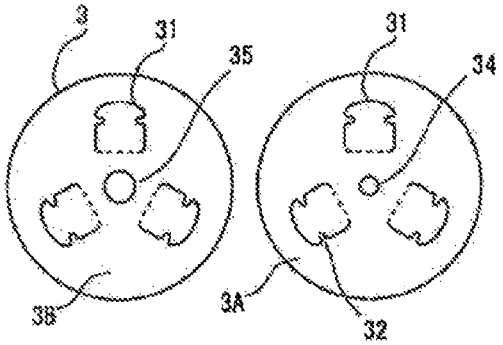
*FIG.3* C
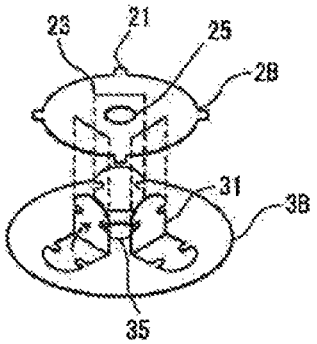

ORNAMENT MANUFACTURING METHOD, ORNAMENT AND STICK TOY

TECHNICAL FIELD

The present invention relates to a stick toy referred to as "Rainbow stick", an ornament used in the stick toy, and an ornament manufacturing method.

BACKGROUND ART

The rainbow stick is a toy which is constituted by a first bonding member fixed to a stick shaft, a second bonding member which is movably bonded to the stick shaft, and a plurality of strip members provided to be able to bend between the first bonding member and the second bonding member. The ends of each of the strip members are attached to the first bonding member and the second bonding member, respectively. This toy is intended to enjoy making various shapes such as a soap bubble, a jelly fish, and a sphere by rotating the stick shaft to change the colors and the shapes of the strip members (see Patent Literature 1). The manufacturing and distribution of this toy has been improved by the inventor, as the vice president of World Rainbow Stick Association.

CITATION LIST

Patent Literature

PTL1: Japanese Utility Model Registration No. 3116440

SUMMARY OF INVENTION

Technical Problem

Now, a conventional method of manufacturing the stick toy, that is, a rainbow stick will be described. First, a tape material or a sheet material is cut into strip members each having a predetermined length. Then, one end of each of the strip members is bonded to the first bonding member having a disk shape. In this case, both ends of each of the strip members are radially bonded to the first bonding member. After that, the other end of each of the strip members is bonded to the second bonding member. As described above, both ends of each of the strip members are radially bonded to the second bonding member. By this means, the ends of each of the strip members are bonded to the first bonding member and the second bonding member, respectively, to make a sphere made of strips. Next, the stick shaft is inserted into the first bonding member and the second bonding member to penetrate their center parts, and then the first bonding member is fixed to the stick shaft while movably attaching the second bonding member to the stick shaft. By this means, when the stick shaft is rotated, the second bonding member is rotated with respect to the first bonding member fixed to the stick shaft, and therefore the shapes of the strip members are changed. In this way, it is possible to manufacture the stick toy intended to provide entertainment with changes in the shapes of the strip members.

However, there has been a problem that this hand working for bonding the strip members to the pair of bonding members one by one has very low productivity and a high cost. In particular, when the strip members are bonded to the pair of bonding members to extend from the center in a radial fashion, it is necessary to be careful to uniform the angles, depths and axes of the strip members. This work is challenging for even a skilled hand. Therefore, even though there is a latent demand for this toy, it is not possible to manufacture in large numbers, and therefore is not possible to promote the sales of the toy. Moreover, the lengths of the strip members are not the same due to the hand work including cutting and bonding, and therefore not only the strip members cannot be formed into a beautiful shape when the stick toy is rotated, but also a long strip may overtake a short one at the time the stick toy is rotated in the opposite direction. Accordingly, the quality of the stick toy has varied.

Solution to Problem

It is therefore an object of the present invention to provide a stick toy having improved productivity and quality, an ornament used in a cover, a mobile, and a lampshade, and a method of manufacturing the ornament.

In order to achieve the object, the present invention solves the above-described problems as follows.

(1) A method of manufacturing an ornament is provided. The method includes: providing a pair of continuous regions facing one another in a flexible sheet; forming a plurality of slits between the pair of continuous regions to form a plurality of ornament strips, wherein the plurality of ornament strips are separated from each other while both ends of the plurality of ornament strips are integrally formed with the pair of continuous regions; and reversing the plurality of ornament strips with respect to the pair of continuous regions such that the plurality of ornament strips radiate outward to form into an arc between the pair of continuous regions, while coupling each of the pair of continuous regions to be formed into a ring.

(2) The method of manufacturing an ornament described as in (1) is provided. A plurality of coupling slits are formed in the pair of continuous regions, and a plurality of coupling protrusions protruding from rims of coupling members each having an approximately disk shape are fitted into the plurality of coupling slits, so that each of the pair of continuous regions is coupled to be formed into a ring.

(3) An ornament is provided. The ornament includes: a pair of continuous regions provided in a flexible sheet and facing one another; and a plurality of ornament strips having a plurality of slits being formed in the flexible sheet between the pair of continuous regions, so that the plurality of ornament strips are separated from each other while both ends of the plurality of ornament strips are integrally formed with the pair of continuous regions. The plurality of ornament strips are reversed with respect to the pair of continuous regions such that the plurality of ornament strips radiate outward to form into an arc between the pair of continuous regions, while coupling each of the pair of continuous regions to be formed into a ring.

(4) The ornament described as in (3) provided. The ornament further includes: a pair of coupling members each having an approximately disk shape and configured to couple the pair of continuous regions to be formed into a ring. Each of the pair of coupling members includes a plurality of coupling protrusions protruding from rims of the pair of coupling members. Each of the pair of continuous regions includes a plurality of coupling slits into which the plurality of coupling protrusions are fitted. The plurality of coupling protrusions are fitted into the plurality of coupling slits, so that each of the pair of continuous regions is coupled to be formed into a ring.

(5) The ornament described as in (3) or (4) is provided. A picture or a pattern is printed on the flexible sheet (1).

(6) The ornament described as in one of (3) to (5) is provided. The ornament is used in a lampshade, a mobile or interior decoration.

(7) A stick toy is provided. The stick toy includes: the ornament described as in one of (3) to (5); a pair of stopper plates spaced from a pair of coupling members at a certain interval, and configured to sandwich the pair of coupling members therebetween from the outside, each of the pair of stopper plates having a diameter greater than that of each of the pair of coupling members; through-holes formed at an approximate center of each of the pair of coupling members and the pair of stopper plates; and a stick inserted into the through-holes and configured to fix one of the coupling members at its top side and to movably hold the other coupling member. The pair of stopper plates is located outside of reversed plurality of ornament strips to control a direction in which the plurality of ornament strips spread.

(8) The stick toy described as in (7) is provided. The stick toy further includes a snag-proof plate located closer to the top of the stick than the one of the coupling members to prevent the plurality of ornament strips from getting entangled, the snag-proof plate being.

According to the present invention, the pair of continuous regions facing one another is provided in the flexible sheet; the plurality of ornament strips are formed between the pair of continuous regions; the plurality of ornament strips are reversed with respect to the pair of continuous regions; and each of the pair of continuous regions is coupled to be formed into a ring; so that it is possible to provide an ornament and a method of manufacturing the ornament with ease and high productivity.

In addition, according to the present invention, the stick toy includes the distinctive coupling members, and therefore it is possible to improve the productivity and reduce the cost.

BRIEF DESCRIPTION OF DRAWINGS

FIG. 1A is an exploded view showing the sheet used in the ornament according to the present invention;

FIG. 1B is an exploded view showing the coupling members used in the ornament according to the present invention;

FIG. 2A is a drawing showing a coupling member;

FIG. 2B is a drawing showing a state in which the continuous region is coupled to be formed into a ring by using the coupling member;

FIG. 2C is a schematic cross sectional view showing a state in which the pair of connection regions are coupled to be formed into rings by using the pair of coupling members, respectively;

FIG. 3A is a drawing showing the coupling members used in the stick toy;

FIG. 3B is a drawing showing the stopper plates used in the stick toy;

FIG. 3C is a drawing showing the coupling member and stopper plate which are engaged with one other;

DESCRIPTION OF EMBODIMENTS

Figure 6:
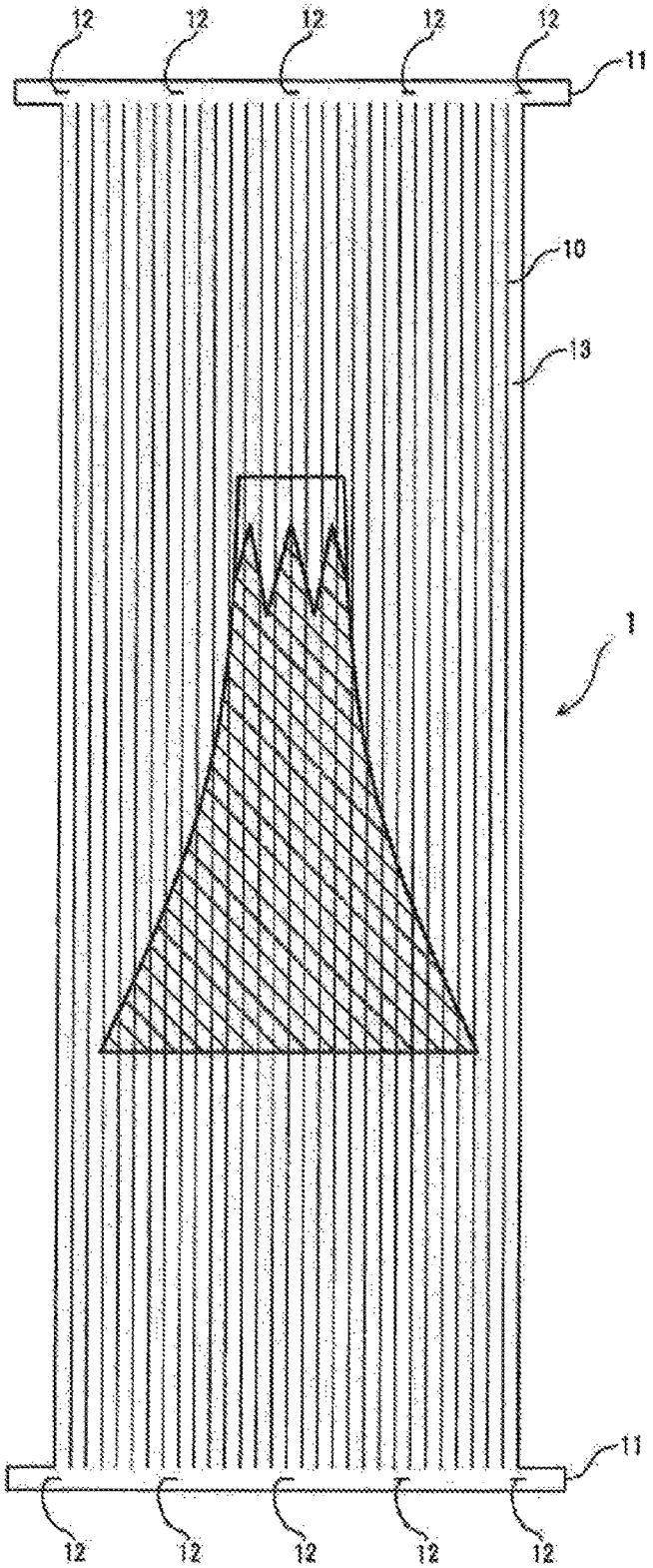
FIG. 6 is a drawing showing a sheet on which a picture is printed.

Hereinafter, the present invention will be described in detail with reference to the drawings. First, FIG. 1 is a drawing showing a sheet 1 and coupling members 2 used in the ornament according to the present invention. The sheet 1 is made of a flexible sheet material, and preferably, be made of a plastic film. Here, the material of the sheet 1 is not limited as long as the sheet 1 has flexibility to the extent that ornament strips described later can be reversed. The sheet 1 may be made of a natural material such as paper and wood, a metal evaporated material such as an aluminum evaporated film, or a metal material such as thin stainless steel. Moreover, the sheet 1 may be made of a composite material formed by bonding a plurality of materials to each other with adhesive, or may be a laminated sheet. Here, although the sheet 1 may be plain, it is more preferred that a pattern or picture is printed on the surface of the sheet 1 as shown in FIG. 6, or the surface of the sheet 1 is colored or subjected to the holographic process to improve the decorative effect. In addition, it is preferred that the thickness of the sheet 1 is 10 μm to 100 μm when an aluminum evaporated film is used. However, the thickness may be appropriately selected depending on the flexibility of the sheet 1 or the intended use of the ornament.

Next, the method of manufacturing an ornament according to the present invention will be described. First, the sheet material is cut into an appropriate size for the intended purpose of the ornament to form the long sheet 1. Then, a plurality of slits 10 which are parallel to each other and extend in a longitudinal direction are formed in the sheet 1. Here, note that the sheet 1 is cut except for a pair of continuous regions 11 formed to face one another in both end parts of the sheet 1. The slits 10 are formed to connect between the pair of continuous regions 11. By this means, it is possible to provide one sheet 1 having a plurality of ornament strips 13 which are separated from each other while the both ends of each of the ornament strips are integrally formed with the pair of continuous regions 11. That is about how to form the ornament strips. Here, although it is preferred that the slits 10 are formed as straight lines, curved slits 10 may be applicable. In addition, it is preferred that the slits 10 are formed at regular intervals, and all the ornament strips have the same width and the same shape. Here, some ornament strips 13 may be cut and removed if necessary.

To form the slits 10 in the sheet 1, a well-known slit formation method may be employed. For example, it is possible to form the slits 10 by punching with a cutter such as a cutting die, laser ablation, and by using a cutting plotter. Here, when the laser ablation is used, gas may be generated during the formation of the slits 10 by the machine, and then the gas may adhere to the transparent film as smudge. To avoid this, it is preferred that the laser ablation is performed after a protective sheet is laminated on the sheet 1, and after that, the protective sheet is peeled off. In addition, when the slits 10 are formed in the sheet 1 which is a thin resin sheet by the laser ablation, the sheet 1 may be molten due to the heat of the laser beam, and therefore it is preferred that the cutting plotter is used to form the slits 10. However, the cutting plotter is not suitable to cut the thick sheet 1. Therefore, it is preferred that the method of forming the slits 10 is appropriately selected depending on the type of the sheet 1. As described above, the formation of the ornament strips 13 in the sheet 1 is automated. Therefore, it is possible to manufacture the ornament strips 13 with higher productivity, more efficiency and higher accuracy than the conventional strip members made by the hand working one by one.

In addition, the continuous regions 11 are formed along the short sides of the sheet 1, respectively, and a plurality of notches as coupling slits 12 are arranged in each of the continuous regions 11 in the short side direction of the sheet 1. The coupling slits 12 may be formed by the same way as the slits 10. Here, it is preferred that the number of the coupling slits 12 is one greater than that of coupling protrusions 21 described later. The coupling protrusions 21 are provided on the rim of each of the coupling members 2 having a disk shape. The coupling protrusions 21 are fitted into the coupling slits 12 while each of the continuous regions 11 is deformed into a ring along the rim of the coupling member 2. In this case, one coupling protrusion 21 is fitted into the two coupling slits 12 located in the vicinity of both ends of the continuous region 11, so that it is possible to arrange the ornament strips 13 along the rim of the coupling member 2 in a seamless manner as a cylinder. In addition, the length of each of the continuous regions 11 is longer than the width of all the ornament strips 13, that is, both ends of the continuous region 11 protrude from the ornament strips 13 arranged in the short side direction of the sheet 1. Therefore, it is possible to prevent the ornament strips 13 from overlapping each other when the continuous region 11 is deformed into a ring, and to have a beautiful shape in a seamless manner as a whole. Here, as shown in FIG. 1, the coupling slits 12 located at the both ends in the short side direction of the sheet 1 are formed in the vicinity of the ornament strips 13 located at the both ends in the short side direction of the sheet 1. By this means, it is possible to prevent the ornament strips 13 from overlapping each other when the sheet 1 is deformed into a ring, and therefore to have a beautiful shape in a seamless manner as a whole.

FIG. 2 is a drawing showing a method of coupling the continuous region 11 to be formed into a ring by using the coupling member 2. As shown in FIG. 2A, the coupling member 2 is formed in a disk shape, and the plurality of coupling protrusions 21 protruding to fit to the coupling slits 12 are arranged on the rim of the coupling member 2. Here, the number of the coupling protrusions 21 may be appropriately determined to stably couple the sheet 1 with the coupling member 2 depending on the length of the continuous region 11, i.e., the short side of the sheet 1. Then, as shown in FIG. 2B, the coupling protrusions 21 are fitted into the coupling slits 12, so that the continuous region 11 is fixed to the rim of the coupling member 2. It is preferred that the size of each of the coupling protrusions 21 is enough to maintain sufficient retention ability after the coupling protrusion 21 is fitted into the coupling slit 12. In addition, the coupling protrusion 21 may be dropped out of the coupling slit 12 depending on the material of the sheet 1 or the coupling member 2, and therefore the coupling protrusion 21 may be bent to prevent the coupling protrusion 21 from dropping out of the coupling slit 12. When a material which is hard to bend is used for the coupling member 2, the coupling protrusion 21 may have a shape such as a hook to prevent the coupling protrusion 21 from dropping out of the coupling slit 12. Moreover, the coupling protrusion 21 may be fixed to the coupling slit 12 with adhesive, or the edges of the continuous regions 11 may adhere to one another.

As shown in FIG. 2C as the schematic cross sectional view, two coupling members 2 are required for one ornament because the coupling member 2 is used in each of the pair of continuous regions 11 of the sheet 1. Here, in FIG. 2C, part of the ornament is omitted. Although it is preferred that the coupling members 2 are made of synthetic resin such as plastic, cardboard or wood may be applicable, and metal may also be applicable. However, when the coupling members 2 are too heavy, the shape of the ornament may be lost, and therefore it is preferred that the coupling members 2 have a light weight, and are appropriately selected depending on the type of the sheet 1. Here, the weight of the coupling members 2 may not be limited as long as a support such as a spacer for maintaining the space between the pair of coupling members 2 is provided.

Next, a method of assembling the ornament according to the present invention will be described. As described above, it is possible to obtain one sheet 1 having the plurality of ornament strips 13 separated from each other while both ends of each of the ornament strips 13 are integrally formed with the continuous regions 11. The method of assembling an ornament according to the present invention includes: reversing the plurality of ornament strips 13 with respect to the pair of continuous regions 11 such that the ornament strips 13 radiate outward to form into an arc between the pair of continuous regions 11; and fitting the coupling protrusions 21 of the coupling members 2 into the coupling slits 12, so that each of the continuous regions 11 is coupled to be formed into a ring. For example, in a case in which, after each of the pair of continuous regions 11 is coupled to be formed into a ring, the ornament strips 13 are reversed with respect to the continuous regions 11, the pair of ringed continuous regions 11 is moved into the plurality of ornament strips 13, and then, the pair of continuous regions 11 is moved from one slit 10 to the outside of the plurality of ornament strips 13 while the pair of continuous regions 11 is turned upside down. That is, the pair of continuous regions 11 is moved such that the back surfaces of the coupling members 2 facing the inside of the plurality of ornament strips 13 are exposed to the outside of the plurality of ornament strips 13. By this means, the rims of the pair of continuous regions 11, which correspond to the short sides of the sheet 1, face one another, and the portions of the pair of continuous regions 11 connecting with the ornament strips 13 are opposite to one another. Therefore, the plurality of ornament strips 13 are reversed to cover the pair of continuous regions 11 from the outside. That is, the ornament strips 13 are reversed such that one surface of each of the ornament strips 13 which is exposed to the outside before being reversed faces one surface of each of the pair of continuous regions 11 on the inside of the ornament strips 13. At this time, the ornament strip 13 is reversed to extend outwardly from the portion connecting with the continuous region 11 and is formed into an arc without twisting and bending at the portion connecting with the continuous region 11. By this means, it is possible to arrange the plurality of ornament strips 13 such that the plurality of ornament strips 13 radiate outward to form into an arc between the pair of continuous regions 11. That is about how to reverse and couple the ornament strips. By this means, each of the continuous regions 11 is coupled to be formed into a ring around the rim of the coupling member 2. As a result, it is possible to manufacture the ornament having the plurality of ornament strips 13 which radiate outward to form into an arc between the pair of continuous regions 11.

The ornament assembled as described above can be used as an indoor or outdoor ornament as an object of art. For example, when the coupling members 2 are hung with thread to use the ornament as a mobile, the ornament strips 13 may be formed with the flexible sheet 1. By this means, it is possible to enjoy viewing unique shape deformation, and therefore to provide a healing effect. In addition, a lighting device, such as an LED lamp is provided between the pair of coupling members 2, and therefore it is possible to use the ornament as a cover of the lighting device or a lampshade. In this case, it is preferred that the ornament strips 13 are configured to keep a definite shape, for example, a spherical shape. For example, by providing a support such as a spacer for maintaining the space between the pair of coupling members 2, it is possible to keep a definite shape of the ornament strips 13 to some extent. Meanwhile, the sheet 1 is formed with a rigid metal material, and therefore it is possible to strengthen the ornament strips 13 in a definite shape. Alternatively, the ornament may be used as a cover for a flower pot and so forth by forming a relatively large opening in the coupling member 2. Here, when a cover having a large diameter is produced by using the ornament according to the present invention, the ornament strips 13 may be formed to extend in the short side direction of the sheet 1, and then assembled in the same way as above. Moreover, when the ornament is made of metal, the ornament may also function as a suspension having impact absorption.

Embodiment 1

The sheet 1 of the stick toy according to the present invention has been described. For example, an aluminum evaporated sheet may be used as the sheet 1. Here, with the conventional manufacturing method, strip members are made by cutting a plurality of strips into short strips each having a predetermined length, and then the strips are bonded to the bonding members one by one. Therefore, in order to achieve a colorful stick toy, various colorful strips are needed. However, with the stick toy according to the present invention, the sheet 1 including the ornament strips 13 which are integrally formed with the continuous regions 11 is used, and therefore it is possible to print a pattern, picture and so forth with a predetermined color combination in a desired position on the sheet 1. Therefore, it is possible to more easily provide beautiful and colorful design, pattern and so forth than the conventional method. It is preferred that the thickness of the sheet 1 of the stick toy is 10 μm to 100 μm, and the sheet 1 provides a high decorative effect with coloring or hologram. Here, by using the flexible sheet 1, when the stick toy according to the present invention is rotated, it is possible to provide more beautiful and colorful presentation than before, thanks to the above-described print such as a picture, or hologram. Here, how to form the ornament strips is the same as above.

FIG. 3 is an exploded view showing coupling members 2A and 2B, and stopper plates 3A and 3B, which are used in the stick toy according to the present invention. As shown in FIG. 3A, the coupling members 2A and 2B of the stick toy according to the present invention have through-holes 24 and 25 at their centers, respectively, into which a long stick 4 is inserted. In addition, coupling slits 23 are formed in the coupling members 2A and 2B to couple the coupling members 2A and 2B with the stopper plate 3A and 3B, respectively. The coupling protrusions 31 of the stopper plates 3A and 3B are fitted into the coupling slits 23. The material of the coupling members 2A and 2B is the same as described above. Here, when the stick 4 of the stick toy is rotated, the stick toy may be broken due to the weight of, in particular, the coupling member 2B in the movable side, and therefore may not provide beautiful presentation of the shape deformation. Therefore, it is preferred that the coupling members 2A and 2B are made of a light material.

The stopper plates 3A and 3B are spaced from at a certain interval and fixed to the coupling members 2A and 2B via the coupling protrusions 31. In addition, each of the stopper plates 3A and 3B is formed in a disk shape having a diameter greater than that of each of the coupling members 2A and 2B. Here, the material of the stopper plates 3A and 3B may be the same as that of the coupling members 2A and 2B, and preferably, is synthetic resin such as plastic. However, this is by no means limiting, but cardboard, wood, and metal may be applicable. Here, when the stick 4 of the stick toy is rotated, the stick toy may be broken due to the weight of, in particular, the stopper plate 3B in the movable side, and therefore may not provide beautiful presentation of the shape deformation. Therefore, it is preferred that the stopper plates 3A and 3B are made of a light material.

Figure 4A:
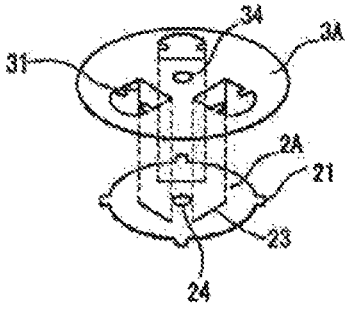
FIG. 4A is a drawing showing a state in which the coupling member is engaged with the stopper plate.
Figure 4B:
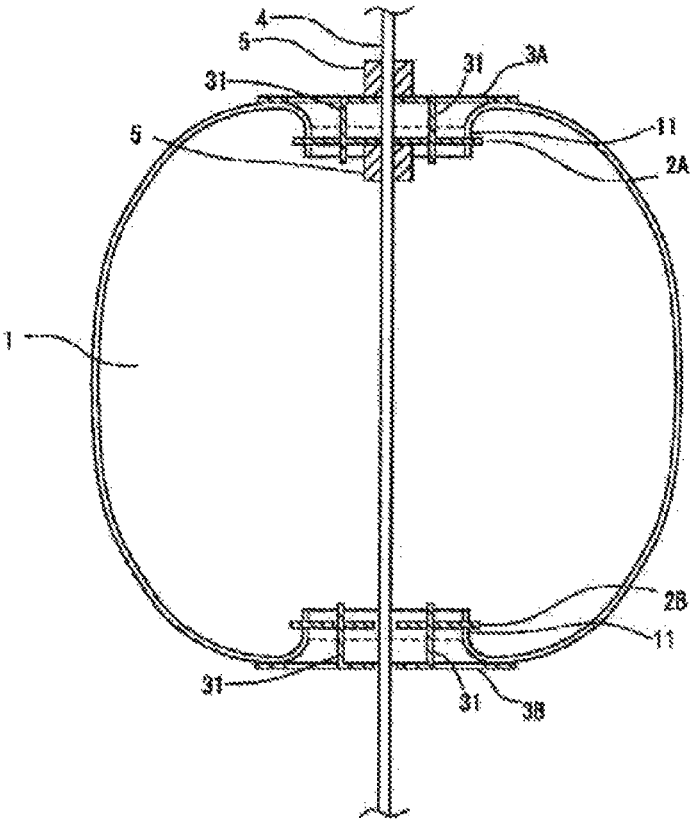
FIG. 4B is a schematic cross sectional view showing the stick toy.

As shown in FIG. 4B, the stopper plates 3A and 3B sandwich the coupling members 2A and 2B with the reversed ornament strips 13 (sheet 1) therebetween from the outside, that is, from the both end sides of the stick 4. By this means, the stopper plates 3A and 3B hold the base parts of the reversed ornament strips 13, and therefore it is possible to control such that the ornament strips 13 spread in the radial direction of the stopper plates 3A and 3B, that is, the direction orthogonal to the stick 4. In addition, as shown in FIG. 3B, through-holes 34 and 35 are formed at the centers of the stopper plates 3A and 3B, respectively, into which the stick 4 is inserted. Moreover, the coupling protrusions 31 are provided in the stopper plates 3A and 3B to couple the stopper plate 3A and 3B with the coupling members 2A and 2B. The coupling protrusions 31 are formed in the stopper plates 3A and 3B by, for example, punching. As shown in FIG. 3C, when the coupling members 2A and 2B are coupled with the stopper plates 3A and 3B, the coupling protrusions 31 are raised approximately vertically from the surfaces of the stopper plates 3A and 3B. In addition, concave parts 32 are formed in each of the coupling protrusion 31. When the coupling protrusion 31 is fitted into the coupling slit 23, the concave parts 32 engage with the coupling slit 23 to lock the coupling. As described above, the coupling protrusions 31 are raised and inserted into the coupling slits 23, and therefore it is possible to maintain a certain distance between the coupling members 2B and the stopper plate 3B, and between the coupling members 2A and the stopper plate 3A, as shown in FIG. 3C and FIG. 4A, respectively. Here, FIG. 3C shows the coupling member 2B and the stopper plate 3B in the movable side, which are located in the base side of the stick 4. Meanwhile, FIG. 4A shows the coupling member 2A and the stopper plate 3A in the stationary side, which are located in the top side of the stick 4.

Then, the coupling member 2A and the stopper plate 3A located in the top side of the stick 4 are fixed to the stick 4 by using a fixture 5 and so forth. It is preferred that this fixture 5 is formed by a cylindrical member having a through-hole with approximately the same diameter as the outer perimeter of the stick 4. In addition, it is preferred that the diameter of the through-hole 24 of the coupling member 2A and the diameter of the through-hole 34 of the stopper plate 3A are approximately the same as the outer perimeter of the stick 4. Meanwhile, the diameter of the through-hole 25 of the coupling member 2B and the diameter of the through-hole 35 of the stopper plate 3B which are located in the base side of the stick 4 may be greater than the outer perimeter of the stick 4 to allow the coupling member 2B and the stopper plate 3B to move with respect to the stick 4.

The method of assembling the stick toy according to the present invention includes: forming the sheet 1 including the ornament strips 13; and fitting the coupling protrusions 31 into the coupling slits 23 to couple the coupling members 2A and 2B with the stopper plates 3A and 3B, so that it is possible to provide the configuration as shown in FIGS. 3C and 4A. Next, fitting the coupling protrusions 21 of the coupling members 2A and 2B into the coupling slits 12 while reversing the ornament strips 13 of the sheet 1; and holding the base part of the ornament strips 13 by the stopper plates 3A and 3B, so that the ornament strips 13 radiate outward to form into an arc as a sphere made of strip. Here, part of the ornament strip 13 is omitted from FIG. 4B. In this case, the stopper plates 3A and 3B function to limit the spreading direction of the ornament strips 13 such that the ornament strips 13 protrude a lot in the radial direction of the stopper plates 3A and 3B and bend, so that the ornament is formed into an substantially perfect oval or sphere.

Figure 5A:
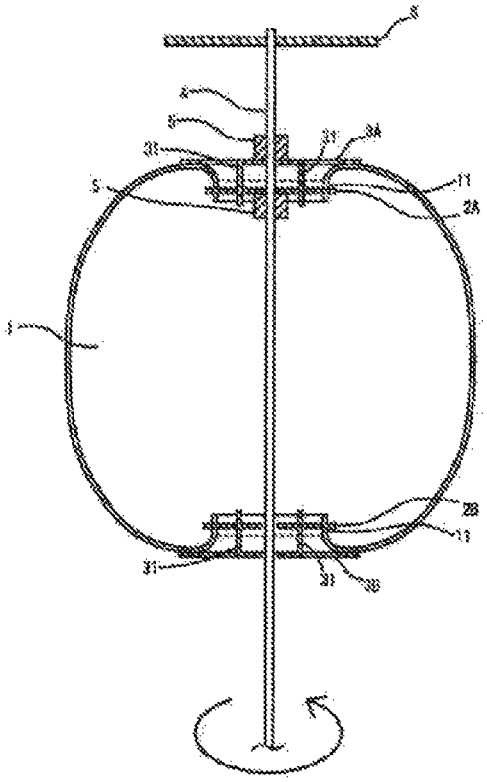
FIG. 5A shows an example of the shape of the stick toy when the stick toy is rotated.
Figure 5B:
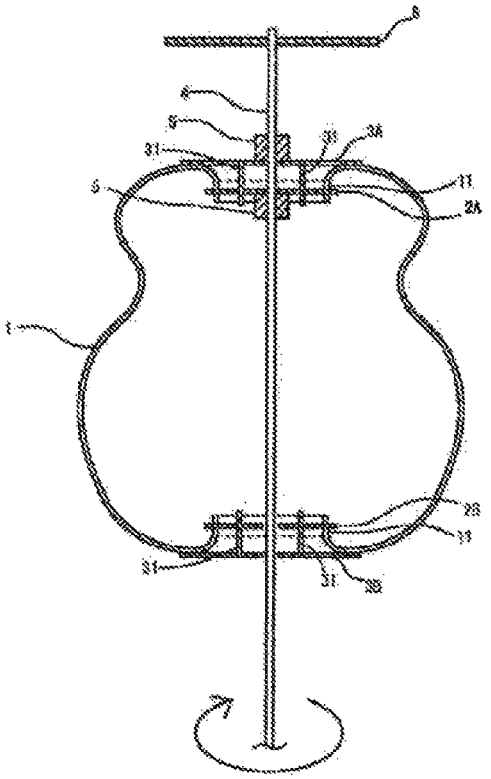
FIG. 5B shows another example of the shape of the stick toy when the stick toy is rotated.

Moreover, the stick toy according to the present invention may include a snag-proof plate 6 located in the vicinity of the top of the stick 4 as shown in FIGS. 5A and 5B. Part of the ornament strips 13 is omitted from FIGS. 5A and 5B. With this configuration, it is possible to prevent the ornament strips 13 from overleaping the top of the stick 4 and getting entangled. It is preferred that the snag-proof plate 6 is made of synthetic resin such as plastic. However, this is by no means limiting, but cardboard, wood, and metal may be applicable. In addition, when the stick toy is used for the promotion of sales, an image, picture or character which provides an advertising effect may be printed on the snag-proof plate 6. The snag-proof plate 6 may be supported by a brace and so forth, and fixed to the stick 4. Alternatively, the snag-proof plate 6 having blades may be movably attached to the stick 4, and rotated as a propeller at the same time the stick toy is rotated. With this configuration, it is possible to enjoy viewing the rotation of the snag-proof plate 6 and changes in the picture, as well as the form deformation of the stick toy.

Then, when the stick 4 is rotated, the outline of the ornament strips 13 is formed into a sphere as shown in FIG. 5A. Then, the stick 4 is suddenly rotated in the opposite direction, the rotations of the coupling member 2B and the stopper plate 3B as free ends in the base side of the stick 4 are delayed, so that the outline of the ornament strips 13 is formed into a daruma shape as shown in FIG. 5B.

Embodiment 2

Embodiment 2 of the present invention is applicable to the above-described embodiment of the ornament and the stick toy, and can improve the decorative effect. To be more specific, an additional sheet is stacked on the above-described sheet 1 while the positions of the coupling slits 12 are shifted from those of the sheet 1, and then the two sheets 1 are coupled to be formed into a ring while being reversed. That is, the ornament strips 13 are formed in the two sheets, respectively, in the same way as described above, and the positions of the coupling slits 12 of one sheet 1 are shifted from those of the coupling slits 12 of the other sheet 1, for example, by one-half of one ornament strip 13. Then, the two sheets 1 are coupled to be formed into a ring while being reversed, so that it is possible to reduce the distance between the ornament strips 13, and therefore to provide a beautiful shape. That is, a plurality of sheets 1 including the coupling slits formed at different positions are used to increase the number of ornament strips 13. It is preferred that the plurality of sheets 1 are wound from the coupling slits 12 to couple continuous regions 11 to the coupling members 2 at the same positions. If only one sheet 1 is used to make a sphere, it may not possible to fill the gaps between the ornament strips 13 only by changing the width of each of the ornament strips 13. As a result, there has been a problem that, even though a delicate pattern is printed on the sheet 1, it is not possible to recognize the pattern. Therefore, the plurality of sheets 1 overlap one another such that the positions of the coupling slits 12 of one sheet 1 are shifted from those of the other sheet 1, and consequently it is possible to fill the gaps between the ornament strips 13 when the sheet 1 is formed into a sphere.

Here, the configurations of the components of the ornament and the stick toy according to the above-described embodiments are merely examples and by no means limiting, and therefore can be modified and altered without deviating the spirit and the scope of the present invention.

REFERENCE SIGNS LIST

1 sheet
10 slit
11 continuous region
12, 23 coupling slit
13 ornament strip
2 coupling member
21, 31 coupling protrusion
24, 25, 34, 35 through-hole
3 stopper plate
32 concave part
33 leg part
4 stick
5 fixture
6 snag-proof plate

The invention claimed is:

1. A method of manufacturing an ornament comprising:

providing a pair of continuous regions facing one another in a flexible sheet;

forming a plurality of slits between the pair of continuous regions to form a plurality of ornament strips, wherein the plurality of ornament strips are separated from each other while both ends of the plurality of ornament strips are integrally formed with the pair of continuous regions; and reversing the plurality of ornament strips with respect to the pair of continuous regions such that the plurality of ornament strips radiate outward to form into an arc and the pair of continuous regions is located inside of the plurality of ornament strips, while coupling each of the pair of continuous regions to be formed into a ring.

2. The method of manufacturing an ornament according to claim 1, wherein a plurality of coupling slits are formed in the pair of continuous regions, and a plurality of coupling protrusions protruding from rims of coupling members each having an approximately disk shape are fitted into the plurality of coupling slits, so that each of the pair of continuous regions is coupled to be formed into a ring.

3. An ornament comprising:

a pair of continuous regions provided in a flexible sheet and facing one another; and a plurality of ornament strips having a plurality of slits being formed in the flexible sheet between the pair of continuous regions, so that the plurality of ornament strips are separated from each other while both ends of the plurality of ornament strips are integrally formed with the pair of continuous regions, wherein the plurality of ornament strips are reversed with respect to the pair of continuous regions such that the plurality of ornament strips radiate outward to form into an arc and the pair of continuous regions is located inside of the plurality of ornament strips, while coupling each of the pair of continuous regions to be formed into a ring.

4. The ornament according to claim 3, further comprising a pair of coupling members each having an approximately disk shape and configured to couple the pair of continuous regions to be formed into a ring, wherein:

each of the pair of coupling members includes a plurality of coupling protrusions protruding from rims of the pair of coupling member;

each of the pair of continuous regions includes a plurality of coupling slits into which the plurality of coupling protrusions are fitted; and the plurality of coupling protrusions are fitted into the plurality of coupling slits, so that each of the pair of continuous regions is coupled to be formed into a ring.

5. The ornament according to claim 3, wherein the flexible sheet includes a surface on which a picture or a pattern is printed.

6. A stick toy comprising:

the ornament according to claim 3;

a pair of stopper plates spaced from a pair of coupling members at a certain interval, and configured to sandwich the pair of coupling members therebetween from the outside, each of the pair of stopper plates having a diameter greater than that of each of the pair of coupling members;

through-holes formed at an approximate center of each of the pair of coupling members and the pair of stopper plates; and a stick inserted into the through-holes and configured to fix one of the coupling members at its top side and to movably hold the other coupling member, wherein the pair of stopper plates is located outside of reversed plurality of ornament strips to control a direction in which the plurality of ornament strips spread.

7. The stick toy according to claim 6, further comprising a snag-proof plate located closer to the top of the stick than the one of the coupling members to prevent the plurality of ornament strips from getting entangled.

8. A lampshade comprising:

an ornament having:

a pair of continuous regions provided in a flexible sheet and facing one another; and a plurality of ornament strips having a plurality of slits being formed in the flexible sheet between the pair of continuous regions, so that the plurality of ornament strips are separated from each other while both ends of the plurality of ornament strips are integrally formed with the pair of continuous regions, wherein the plurality of ornament strips are reversed with respect to the pair of continuous regions such that the plurality of ornament strips radiate outward to form into an arc and the pair of continuous regions is located inside of the plurality of ornament strips, while coupling each of the pair of continuous regions to be formed into a ring.

* * * * *